US011407561B2

(12) United States Patent
Guindi et al.

(10) Patent No.: US 11,407,561 B2
(45) Date of Patent: Aug. 9, 2022

(54) PORTABLE BASKET WITH MOVEABLE SUPPORT MEMBERS

(71) Applicants: Henry Guindi, Old Bridge, NJ (US); Justin Tranchina, Old Bridge, NJ (US)

(72) Inventors: Henry Guindi, Old Bridge, NJ (US); Justin Tranchina, Old Bridge, NJ (US)

( * ) Notice: Subject to any disclaimer, the term of this patent is extended or adjusted under 35 U.S.C. 154(b) by 0 days.

(21) Appl. No.: 16/792,962

(22) Filed: Feb. 18, 2020

(65) Prior Publication Data

US 2021/0253302 A1 Aug. 19, 2021

(51) Int. Cl.
*B65D 21/06* (2006.01)
*B65D 21/02* (2006.01)

(52) U.S. Cl.
CPC ..... *B65D 21/066* (2013.01); *B65D 21/0215* (2013.01)

(58) Field of Classification Search
CPC . B65D 21/066; B65D 21/0215; B65D 21/062
USPC ..... 206/503, 505, 506
See application file for complete search history.

(56) References Cited

U.S. PATENT DOCUMENTS

| | | | | |
|---|---|---|---|---|
| 7,478,726 | B2 | 1/2009 | Apps et al. | |
| 2002/0190176 | A1* | 12/2002 | Louh | B60R 11/0241 248/316.4 |
| 2010/0133266 | A1 | 6/2010 | Cook et al. | |
| 2019/0047748 | A1 | 2/2019 | Hernandez et al. | |
| 2019/0322417 | A1* | 10/2019 | Hurt | B65D 21/062 |

* cited by examiner

*Primary Examiner* — Andrew D Perreault
(74) *Attorney, Agent, or Firm* — Ezra Sutton; Anthony Morano

(57) ABSTRACT

The present invention provides a stackable container, including a base wall having multiple corners, a side wall that is generally perpendicular to the base wall, and an end wall that is generally perpendicular to the base wall and the side wall. The base wall, the side wall, and the end wall are substantially rectangular or square in shape and define an interior space. Also, a plurality of retractable support members are provided that are movable between an extended support position and a retracted position. The support members, located at the four bottom corners or four sides of the base wall of the stackable container, support the stackable container on top of another container, when the support members are in an extended support position. When the support member is in a retracted position, the containers may be nested. In an alternate embodiment, the container may have a round shape with retractable support members.

7 Claims, 18 Drawing Sheets

PORTABLE BASKET WITH MOVEABLE SUPPORT MEMBERS

FIELD OF THE INVENTION

The present invention relates to stackable containers having movable support members for stacking or nesting.

BACKGROUND OF THE INVENTION

When a plurality of containers are used to hold items to be segregated by size, type, color, weight or the like, such as laundry, trash or the like, it is often a convenient savings of floor space if such containers can be stacked on each other or nested. Numerous types of storage containers or bins of the type which are stackable are known in the art. Many of these stackable storage containers or bins are used for storage and/or display of a variety of articles, goods, laundry, trash or the like.

However, many of these stackable containers or bins suffer from one or more deficiencies. For example, in many such containers, the stable stacking thereof is not a simple process with the user having to exercise a high degree of care in tending to the proper stacking and placement of the containers. In addition, when stacked, most prior art structures do not provide a conveniently sufficient access opening, and in some instances, the containers actually must be at least partially unstacked in order to gain access to the contents. Moreover, these same containers, when stacked, because of their configuration, do not stack in a accessible vertical fashion thereby rendering it inconvenient, if not impossible, to stack such containers while still having access to the contents of the containers.

Thus, there is still a need for a stackable storage container or bin which is selectively stackable, so that it is securely and removably interlocked with a lower bin when it is stacked thereon, such that the contents of the stacked containers are easily accessible to the user. Further, the bins or containers must be able to nest within each other when they are not stacked.

Also, there is a need to have such stackable containers with the foregoing features that have different shapes, such as square, round, rectangular, or other shapes.

DESCRIPTION OF THE PRIOR ART

Numerous prior art patents and patent applications disclose various structures for facilitating the stacking of containers or bins.

For instance, US Patent Publication No. 2010/0133266 to Alan J. Cook, et al. entitled "Container with Retractable Supports" which published on Jun. 3, 2010 discloses a collapsible container including a base, a pair of opposed side walls, and a pair of opposed end walls which are transverse to the side walls. The side and end walls are pivotably connected to the base between an upright position, generally perpendicular to the base, and a collapsed position on the base. A support is pivotably mounted to each of the end walls. The supports are movable to a support position extending into the container and to a retracted position.

Similarly, U.S. Pat. No. 7,478,726 to William P. Apps, et al. entitled "Collapsible Crate with Support Members" which published on Jun. 3, 2010 discloses a collapsible crate with retractable support members which are selectively movable between a retracted position and a support position. In the retracted position, each support member is disposed within one of the walls. In the support position, the support member extends diagonally across a corner and is supported at opposite ends by adjacent walls.

Korean Patent Publication No. KR101891060 to Yoon Soo Kim entitled "Liftable Laundry Basket" which published on Aug. 22, 2018 discloses stackable laundry baskets with pivotable shelves for facilitating stacking of the laundry baskets.

US Patent Publication No. 2019/0047748 to Rolando Hernandez, et al. entitled "Stackable Container" which published on Feb. 14, 2019 discloses a container capable of being placed in a stacking configuration with an identical second container. To facilitate stacking, the container includes first and second channels that are molded into, or formed within, the bottom and at least partially protrude into the inner space. The channels form recesses capable of receiving the first and second handles, respectively, of any other identical container.

However, none of the aforementioned prior art references teach or disclose the structure of a stackable container having a plurality of retractable support members each having a slideable arm, wherein each slidable arm is movable into and out of a groove or pocket formed in the base wall of the container, such that the support member is movable between an extended support position and a retracted position.

OBJECTS OF THE INVENTION

It is an object of the present invention to provide stackable containers for use in homes, offices or workshops for work space organization.

Another object of the present invention is to provide stackable containers that may be easily stacked by use of a plurality of retractable support members that are supported on another container below it.

Another object of the present invention is to provide stackable containers which can be stacked with similar or dissimilar containers having different shapes or sizes.

Another object of the present invention is to provide stackable containers wherein each stackable container has a shape of predetermined size and useable volume so that the container can be used to hold different types of products in an efficient manner.

Another object of the present invention is to provide stackable containers of any shape, such as square, round, rectangular, or any other shape.

Another object of the present invention is to provide stackable containers, wherein the top container can be rotated 180° relative to a lower container and stacked thereon.

Another object of the present invention is to provide stackable containers or bins that nest within each other, when they are not stacked.

SUMMARY OF THE INVENTION

The present invention provides a stackable container, having a base wall and multiple corners, a side wall that is generally perpendicular to the base wall, and an end wall that is generally perpendicular to the base wall and the side wall. The base wall, the side wall, and the end wall are preferably substantially rectangular or square in shape and define an interior space. Also, a plurality of retractable support members are provided that are movable between an extended support position and a retracted position for nesting. The support members located at the four bottom corners or four sides of the base wall of the stackable container, support the stackable container on top of another container when the support members are in an extended support position.

Each support member has a slideable arm that is movable into or out of a groove or pocket formed in the base wall that is shaped to receive the support member. Preferably each of the support members fits flush within the groove, and forms part of the base wall when each of the support members is in the retracted position, so that the containers may be nested. The slideable arm of each support member may have a substantially rectangular shape.

The stackable container having retractable support members may be containers that are of any shape, such as square, rectangular, or round.

DETAILED DESCRIPTION OF THE PREFERRED EMBODIMENT

Figure 1:
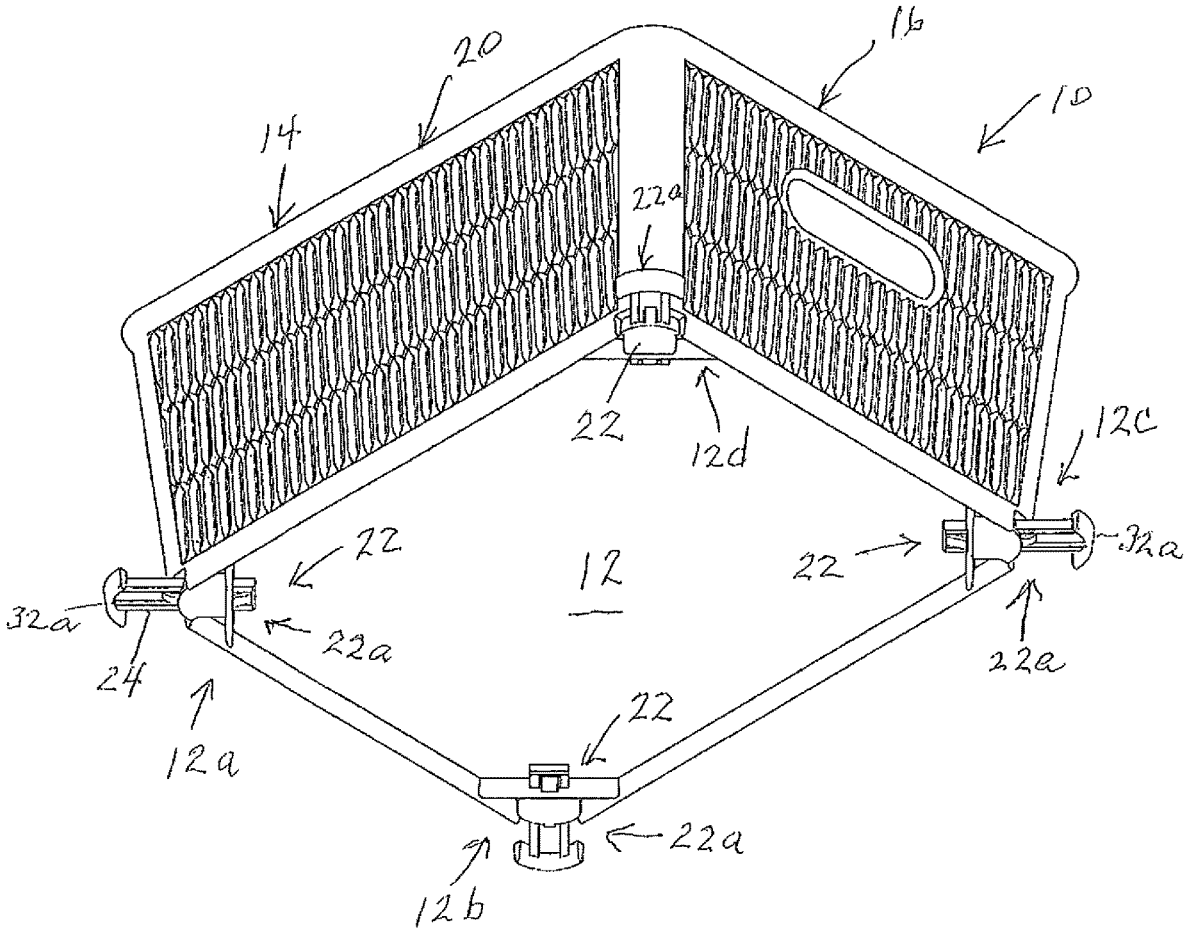
FIG. 1 is a front perspective view of a stackable container.
Figure 2:
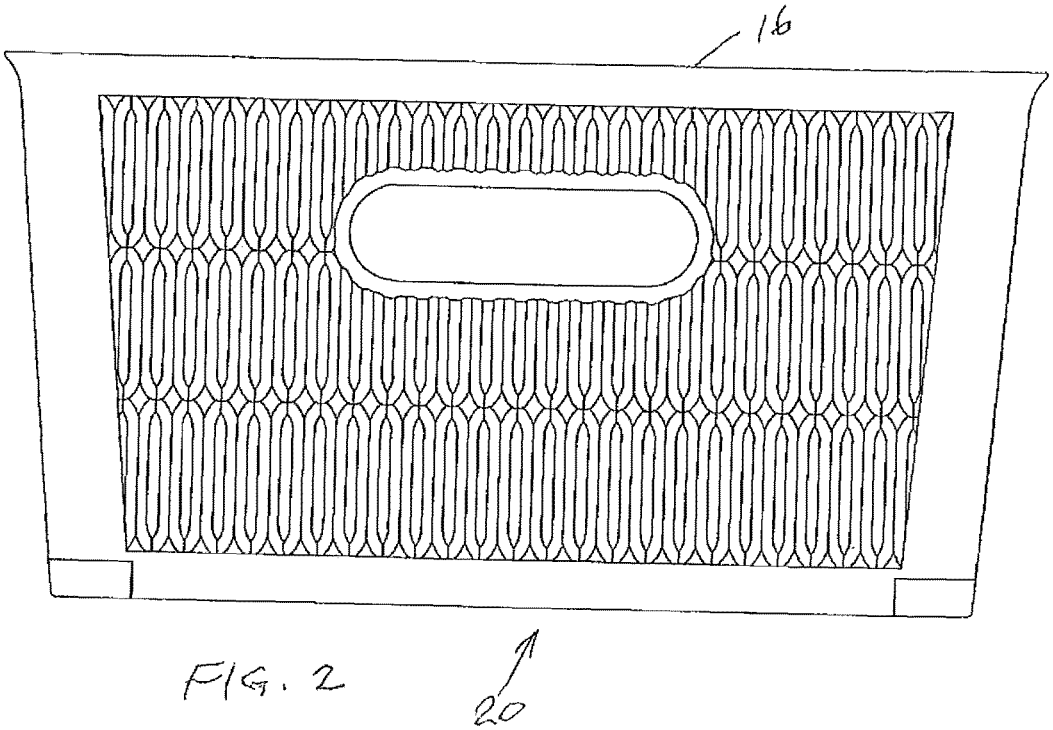
FIG. 2 is an end elevational view of the stackable container shown in FIG. 1.
Figure 3:
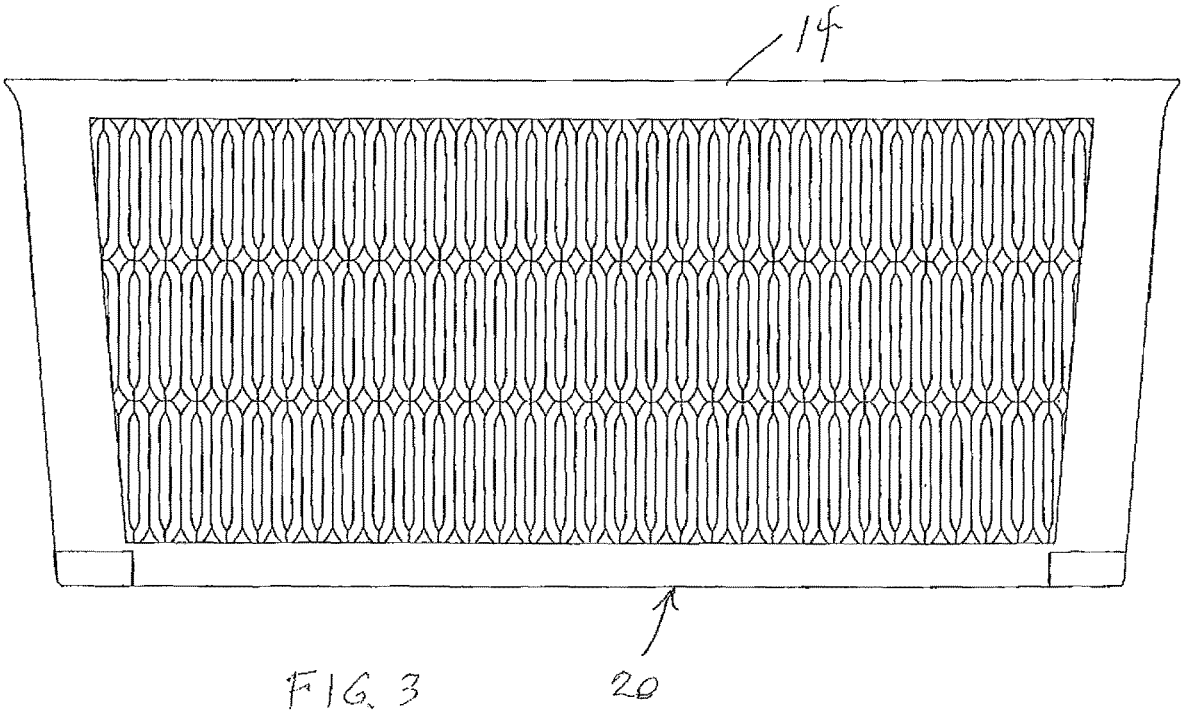
FIG. 3 is a side elevational view of the stackable container shown in FIG. 1.
Figure 4:
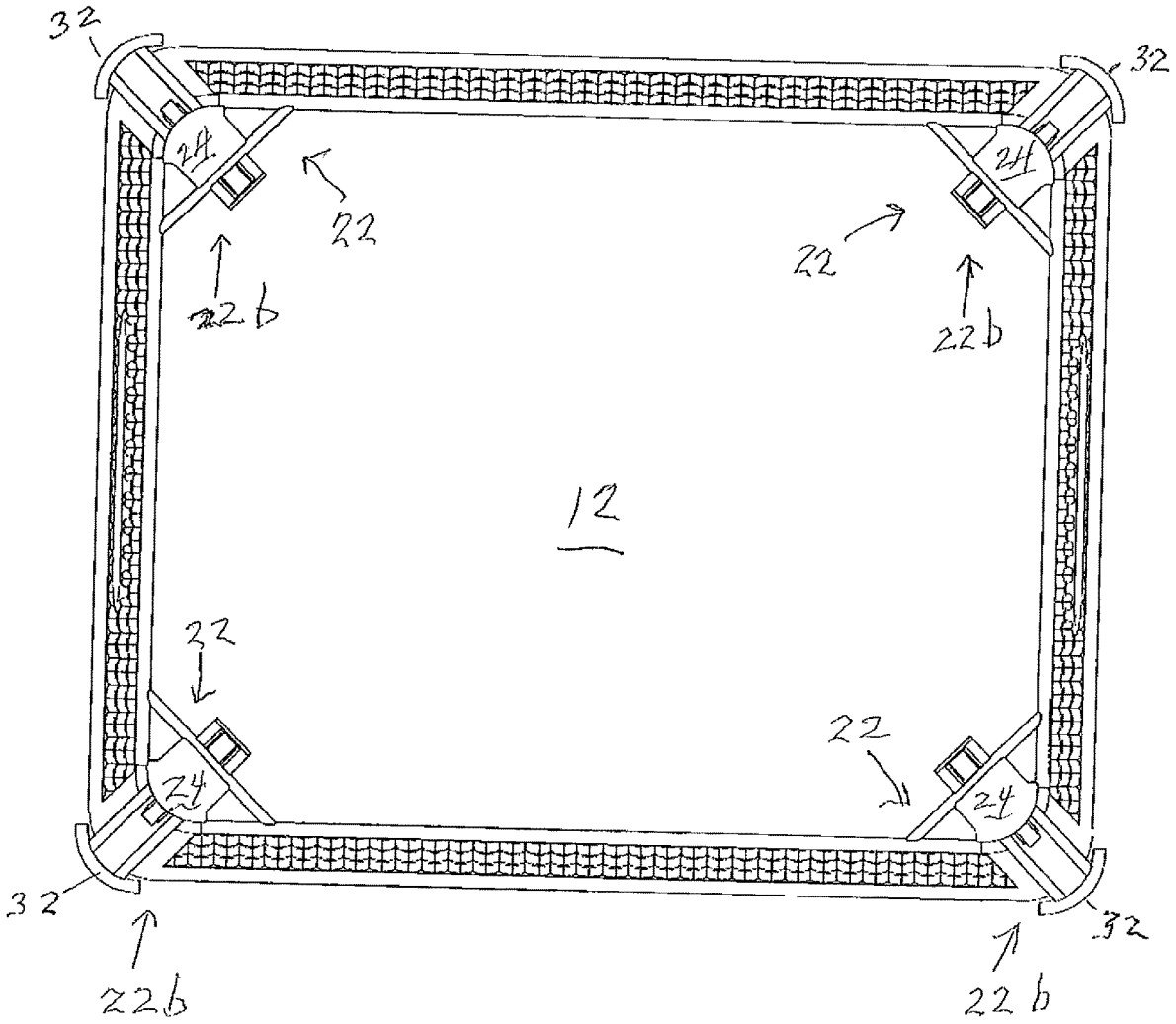
FIG. 4 is a bottom plan view of the stackable container shown in FIG. 1, wherein the support member 22 is in the extended position.
Figure 5:
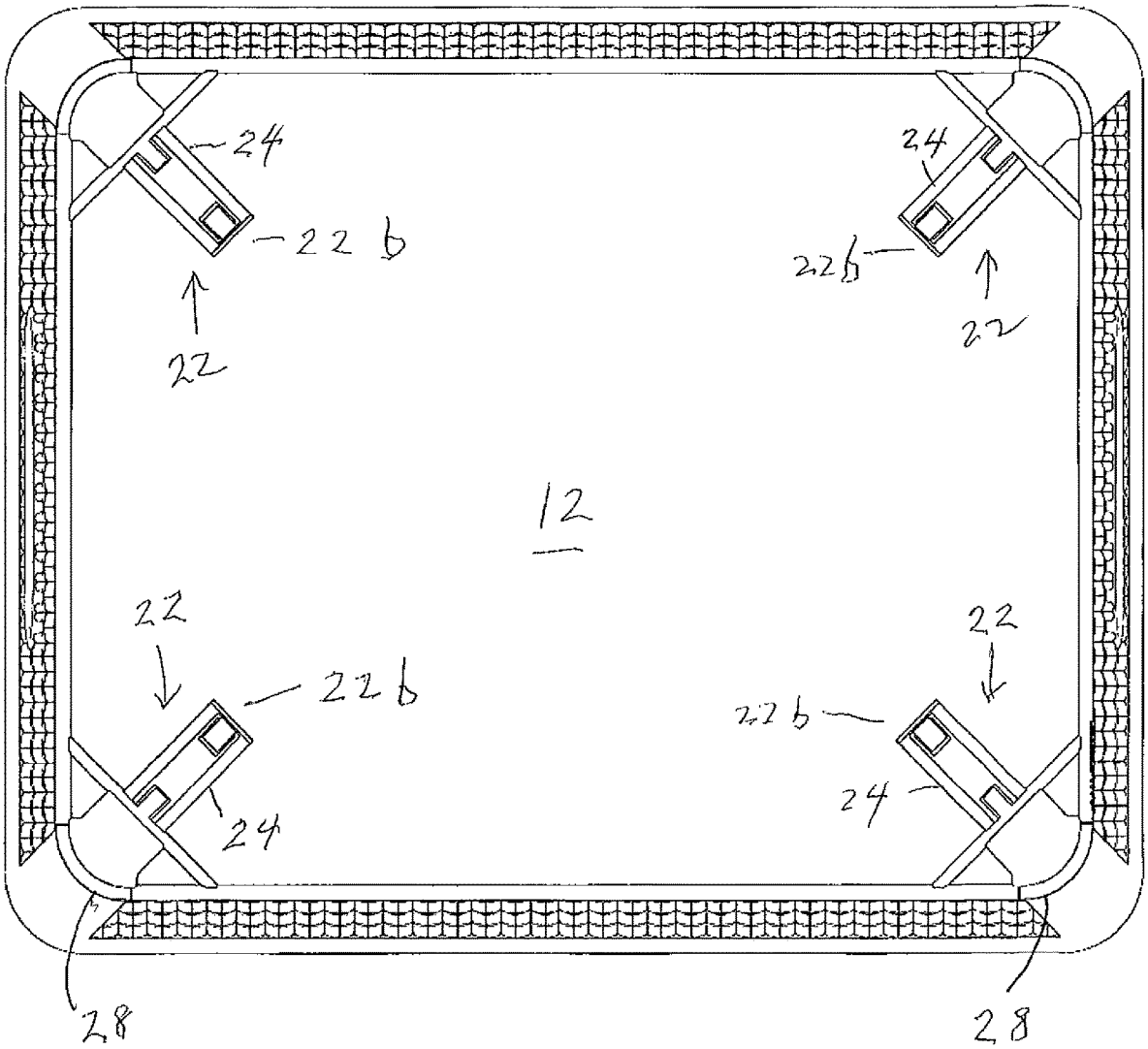
FIG. 5 is a bottom plan view of the stackable container shown in FIG. 1, wherein the support member 22 is in the retracted or closed position.

The present invention provides a stackable container 10, including a base wall 12 having multiple corners, a side wall 14 that is generally perpendicular to the base wall 12, and an end wall 16 that is generally perpendicular to the base wall 12 and the side wall 14. The base wall 12, the side wall 14, and the end wall 16 are preferably substantially rectangular or square in shape and define an interior space 20. Also, a plurality of retractable support members 22 are provided that are movable between an extended support position 22*a* and a retracted position 22*b*. The support members 22, preferably located at the four bottom corners of the base wall 12*a*, 12*b*, 12*c*, 12*d* of the stackable container, support the stackable container 10 on top of another container 10 when the support members 22 are in the extended support position 22*a*.

Figure 6:
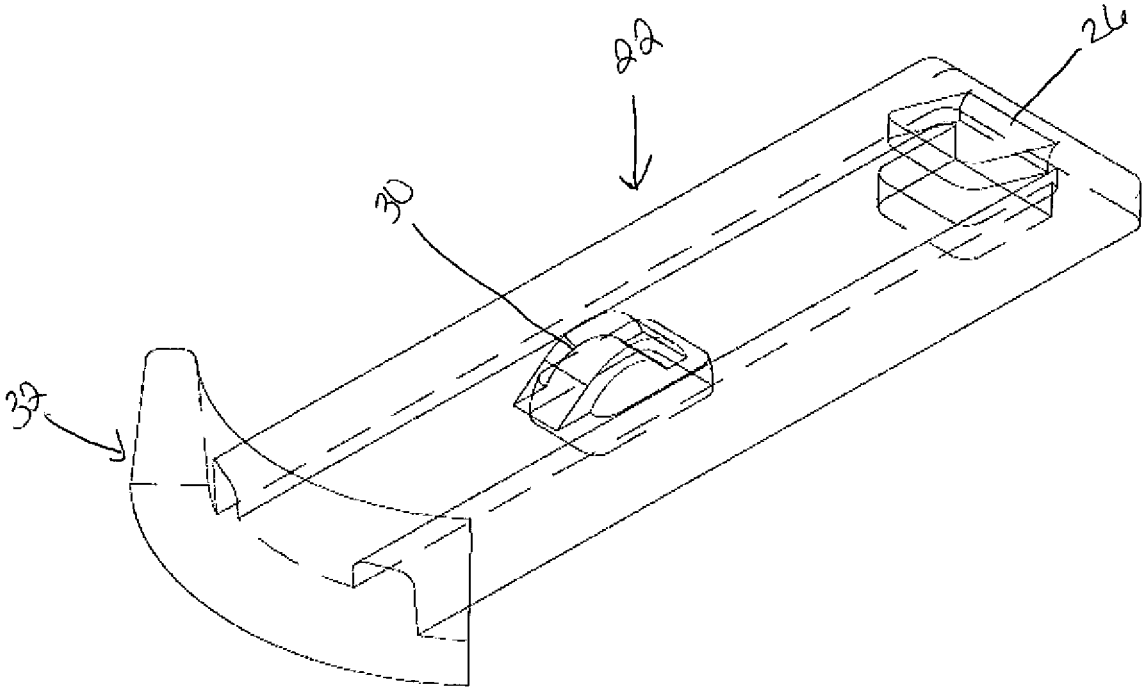
FIG. 6 is a perspective view of support member 22 having a stop member 26 and a hook 30.
Figure 7:
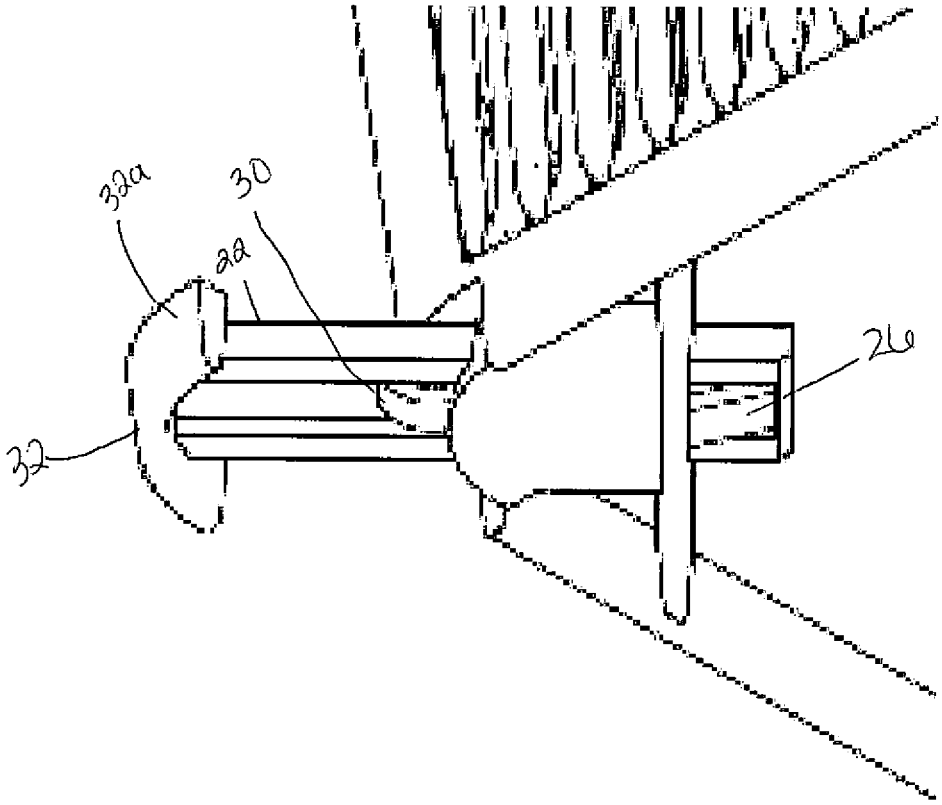
FIG. 7 is an enlarged perspective view of support member 22 in the extended position.
Figure 8:
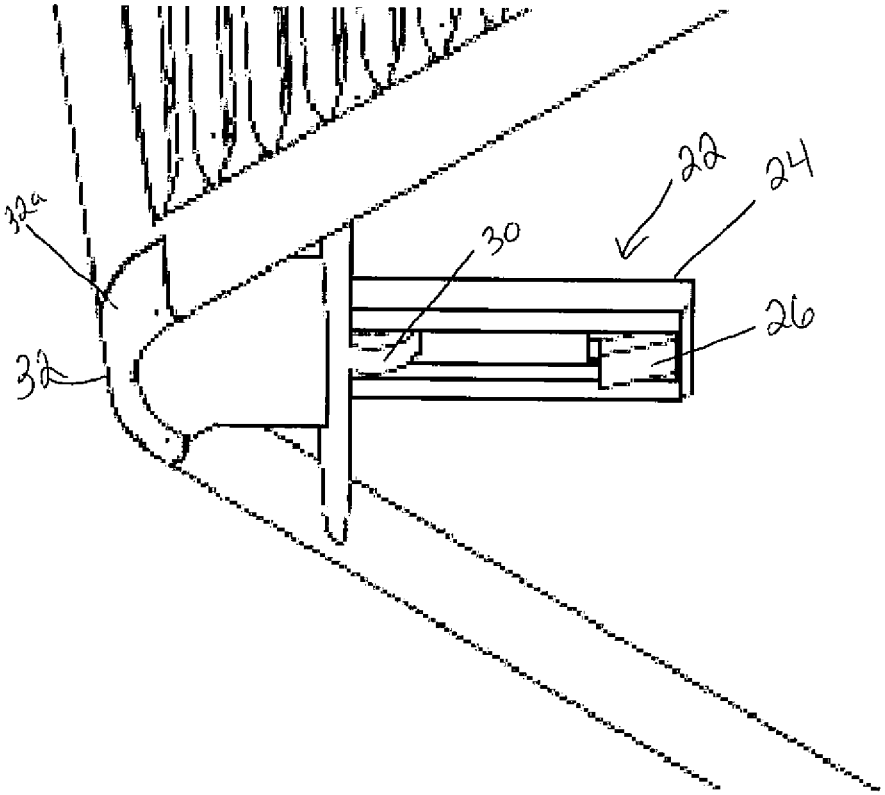
FIG. 8 is an enlarged perspective view of support member 22 in the retracted position, wherein surface 32 is flush with the side walls of the container.

As shown in detail in FIGS. 6, 7, and 8, each support member 22 has a slideable arm 24, a locking hook 30, which locks slideable arm 24 into its extended position, and a stop member 26, which are all movable in a groove 28 formed in the base wall 12 that is preferably at least partially shaped to receive the support members 22. Preferably each of the support members 22 fits flush within and forms part of the base wall 12 when each of the support members 22 is in the retracted position. The curved end member 32 of each arm 24 preferably has a substantially curved end shape 32*a* and is substantially perpendicular to the slideable arm 24. The slideable arm 24 of each support member 22 preferably has a substantially rectangular shape.

Figure 9:
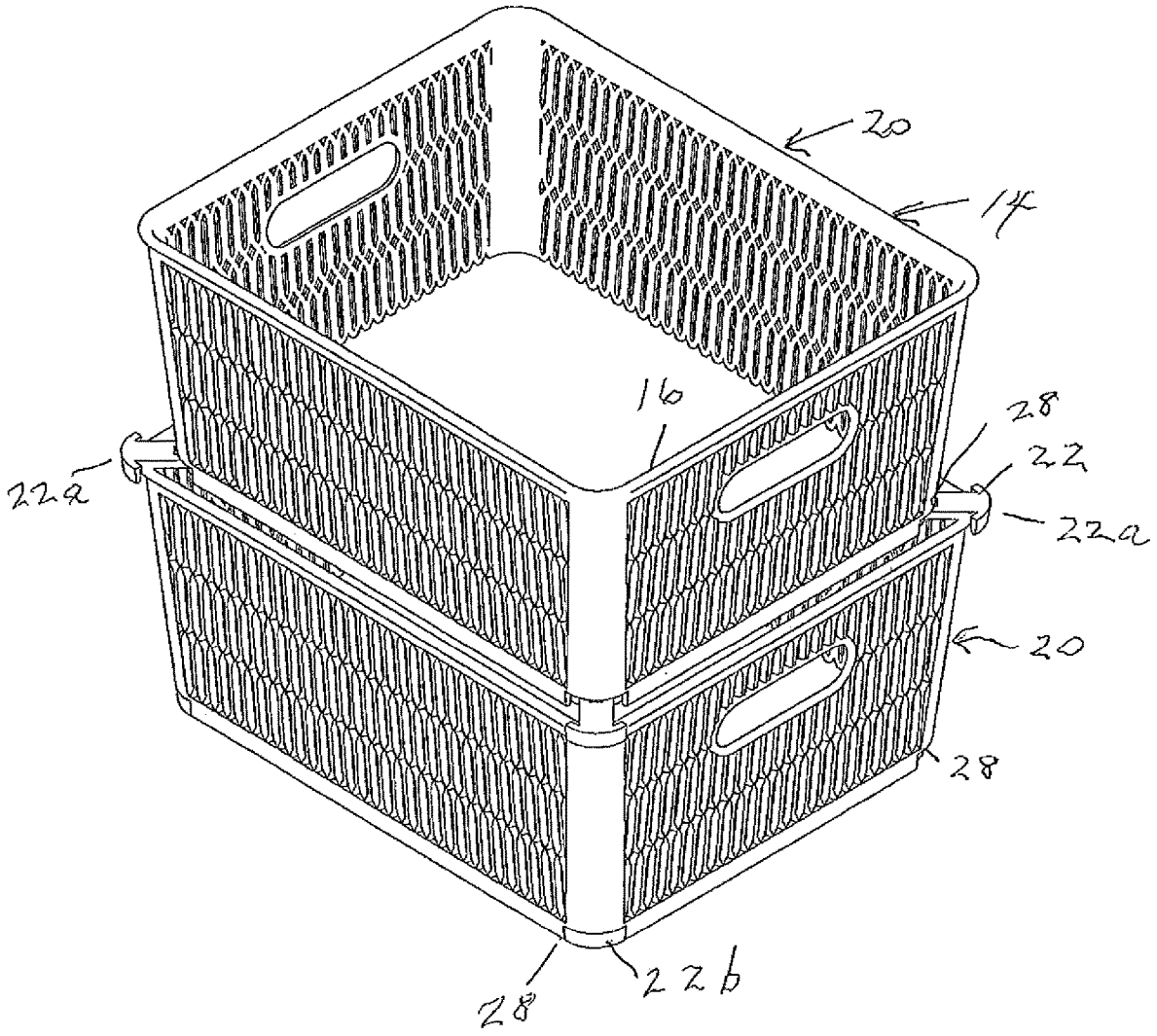
FIG. 9 is a perspective view of two containers stacked above each other, wherein the corner support members 22 are supporting the upper container.

FIG. 9 shows a perspective view of the two containers 20 stacked above each other, wherein the corner support members 22 are supporting the upper container 20.

Figure 10:
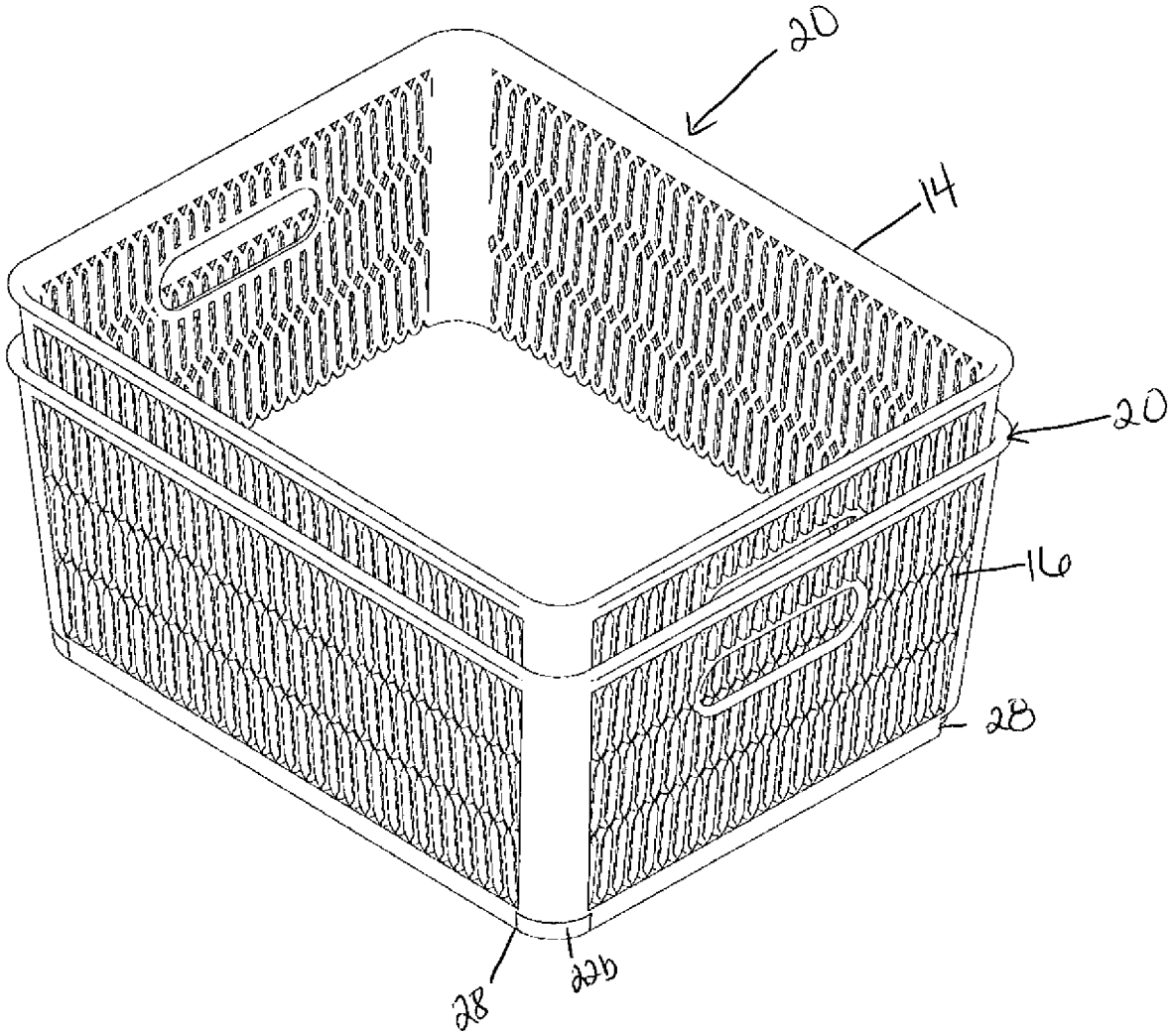
FIG. 10 is a perspective view of two containers nested inside each other, wherein the corner support members 22 are in their retracted positions.

FIG. 10 is a perspective view of the two containers 20 nested inside each other, wherein the corner support members 22 are in their retracted positions.

Second Embodiment

Figure 11:
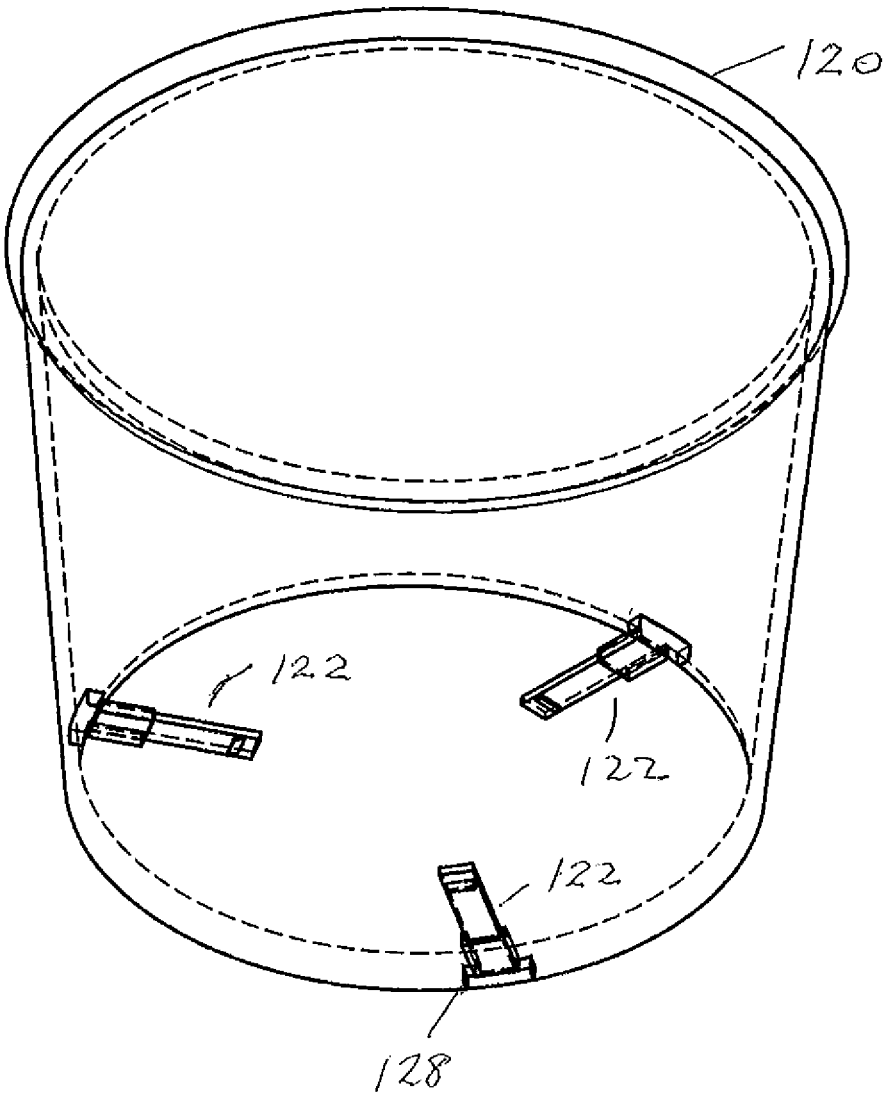
FIG. 11 is a perspective view of a second embodiment of a stackable container 120 having a circular shape and having at least three retractable support members 122 around the bottom surface.

FIG. 11 is a perspective view of a second embodiment of a stackable container 120 having a circular shape and having at least three retractable support members 122 around the bottom surface of container 120.

Figure 12:
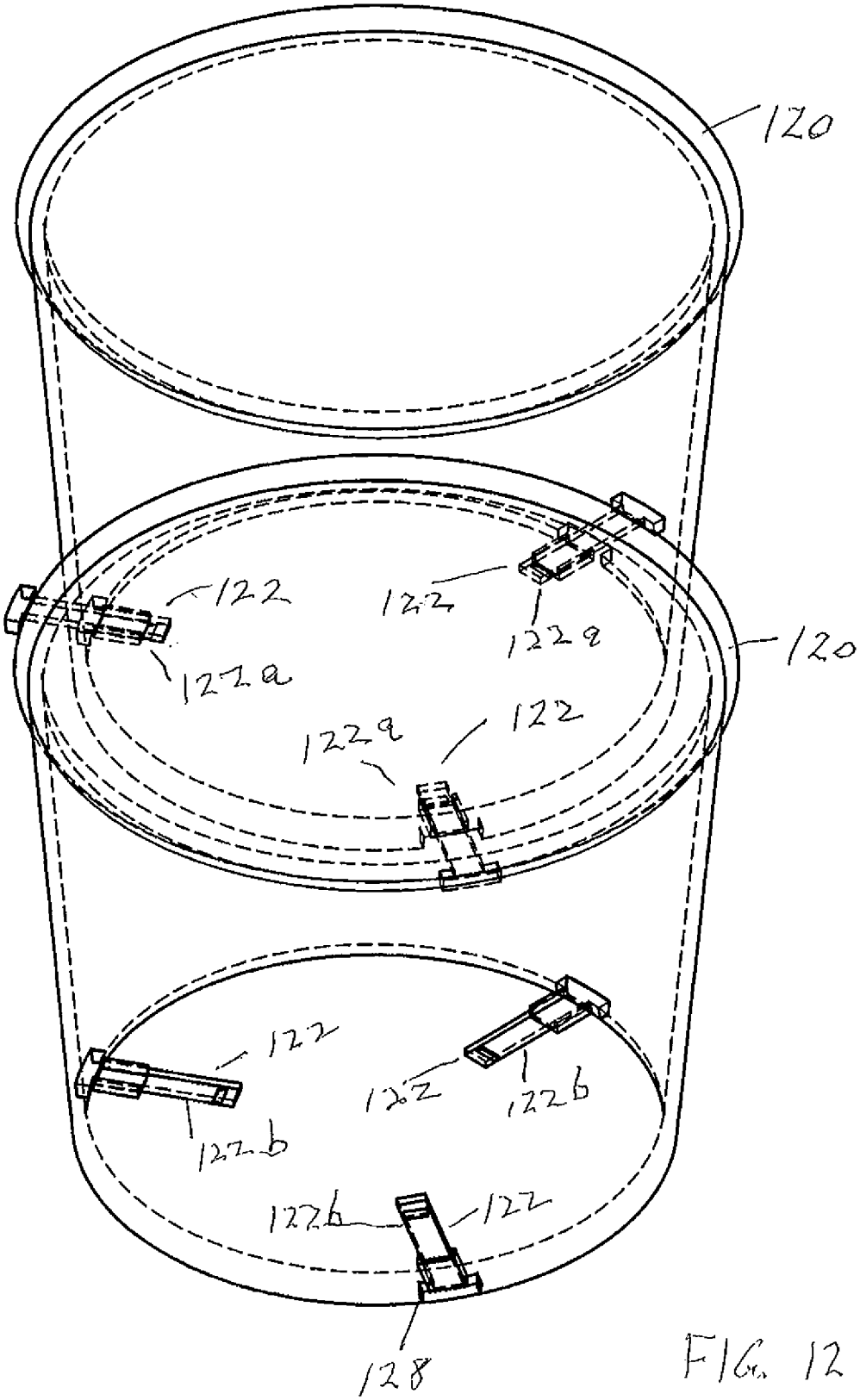
FIG. 12 is a perspective view of the second embodiment of showing two stacked containers 120 each having a circular shape and each having at least three retractable support members 122 around the bottom surface of each, wherein the support members 122 are supporting the upper circular container.

FIG. 12 is a perspective view of the second embodiment showing two stacked containers 120 each having a circular shape and each having at least three retractable support members 122 around the bottom surface of each, wherein the retractable support members 122 are supporting the upper circular container 120, and wherein support members 122 are each moveable into and out of a groove 128 formed in the base wall 112, so that each groove 128 is shaped to receive the support member 122.

Figure 13:
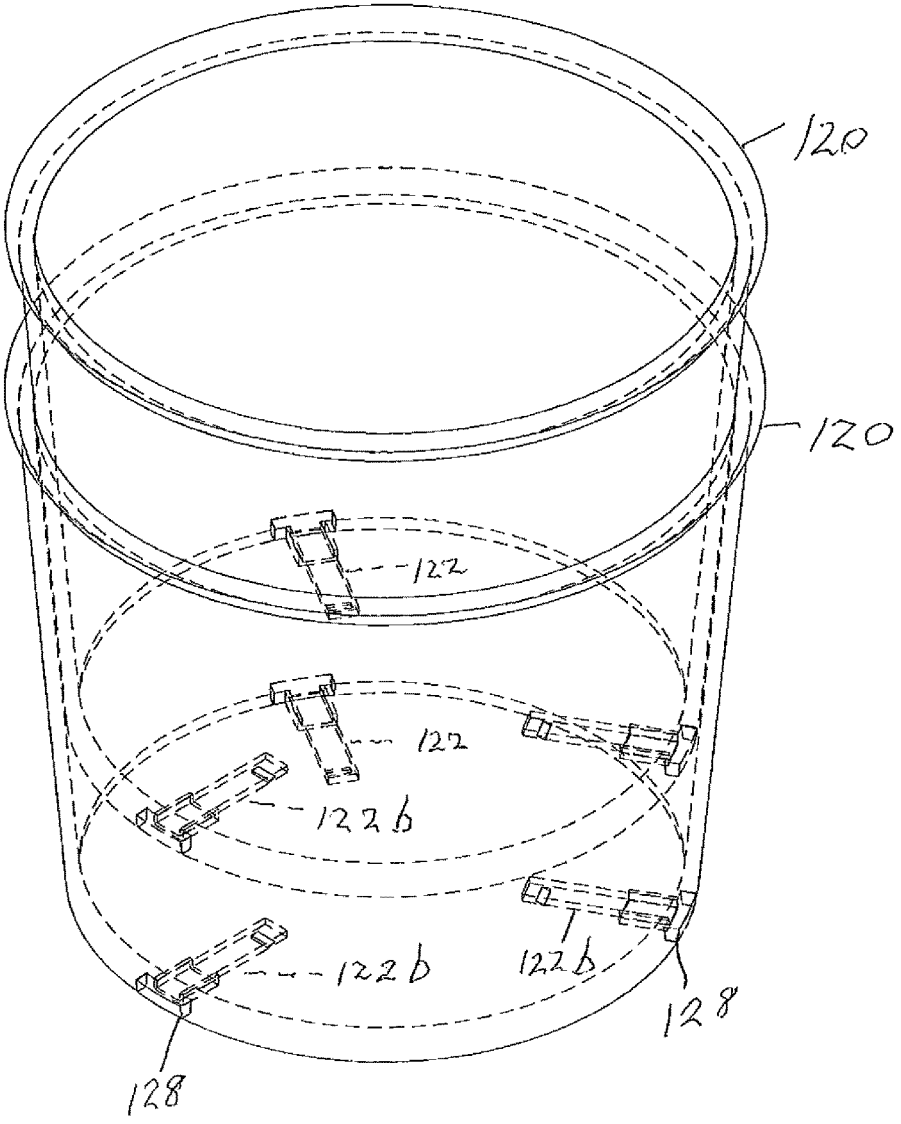
FIG. 13 is a perspective view of the second embodiment of showing two containers 120 each having a circular shape and each having at least three retractable support members 122 around the bottom surface of each, wherein the containers are nested inside each other, and wherein the corner support members 122 are in their retracted positions.

FIG. 13 is a perspective view of the second embodiment showing two containers 120 each having a circular shape and each having at least three retractable support members 122 around the bottom surface of each, wherein the circular containers 120 are nested inside each other, and wherein the retractable support members 122 are in their retracted positions.

Figure 14:
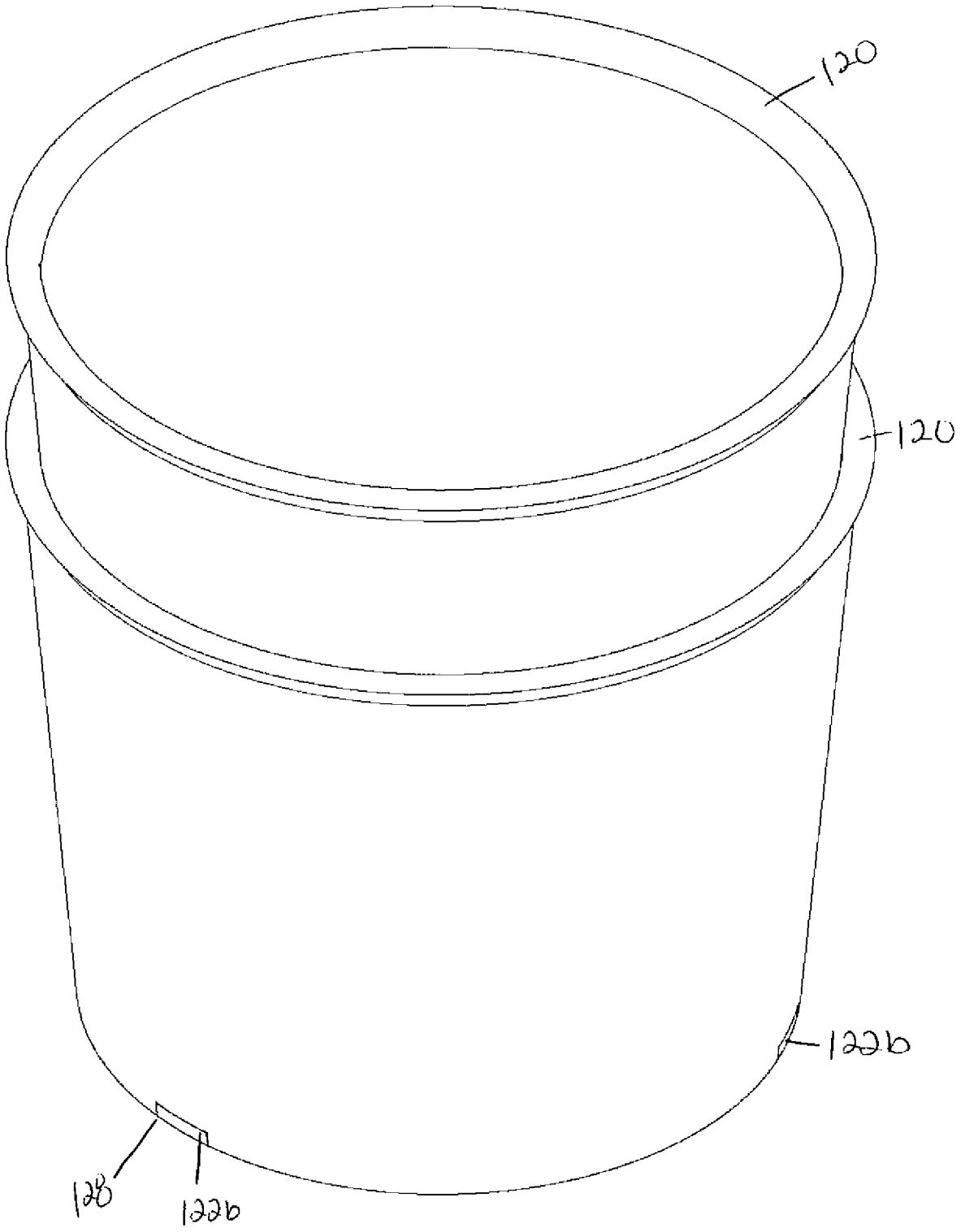
FIG. 14 is a perspective view of two containers nested inside each other, wherein the support members 122 are in their retracted positions.

FIG. 14 is a perspective view of two containers 120 nested inside each other, wherein the retractable support members 122 are in their retracted positions, so the containers can nest with each other.

Third Embodiment

Figure 15:
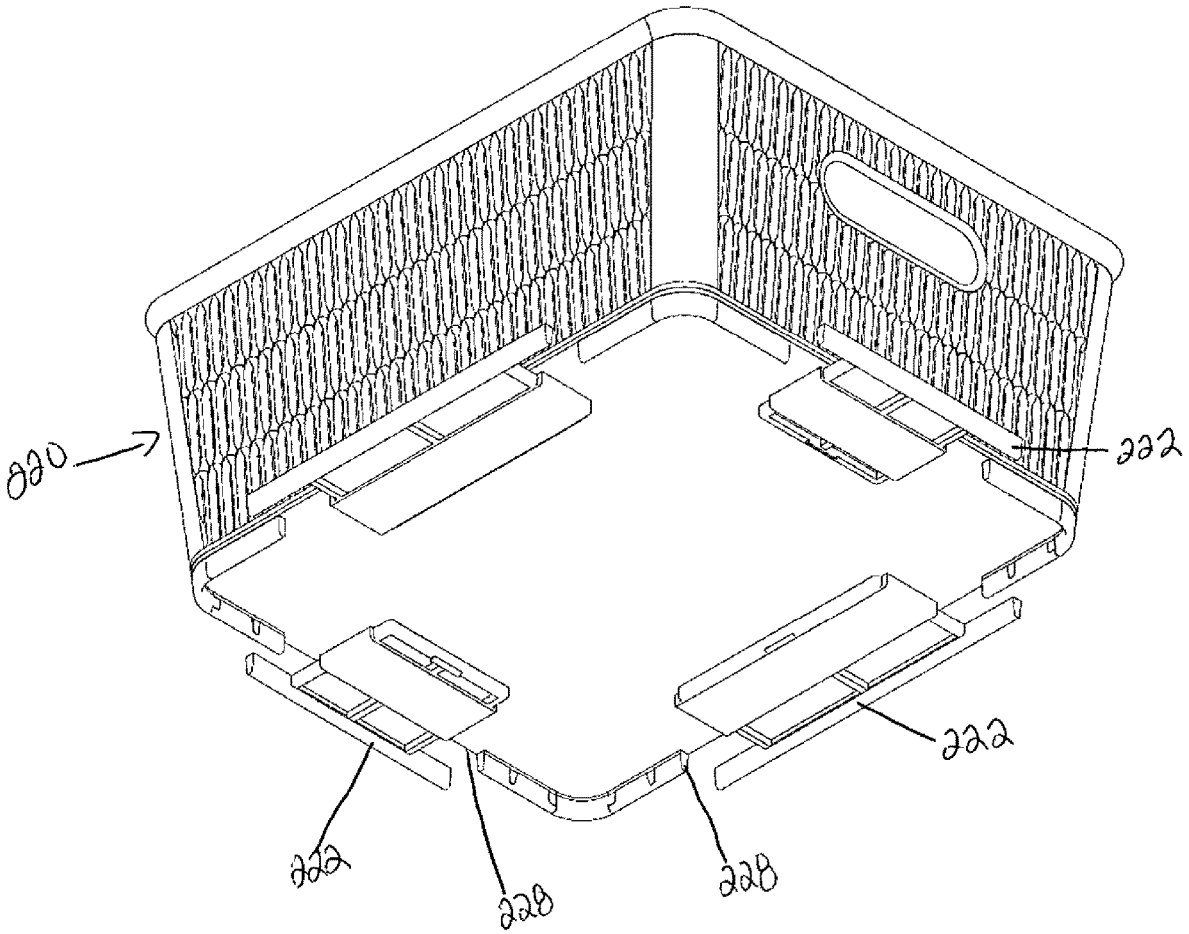
FIG. 15 is a perspective view of a third embodiment of a stackable container 220 having a rectangular shape and having four retractable side support members 222 on each side of the bottom surface.

FIG. 15 is a perspective view of a third embodiment of a stackable container 220 having a rectangular or square shape and having four retractable support members 222, one on each of the four sides of the bottom surface of container 220.

Figure 16:
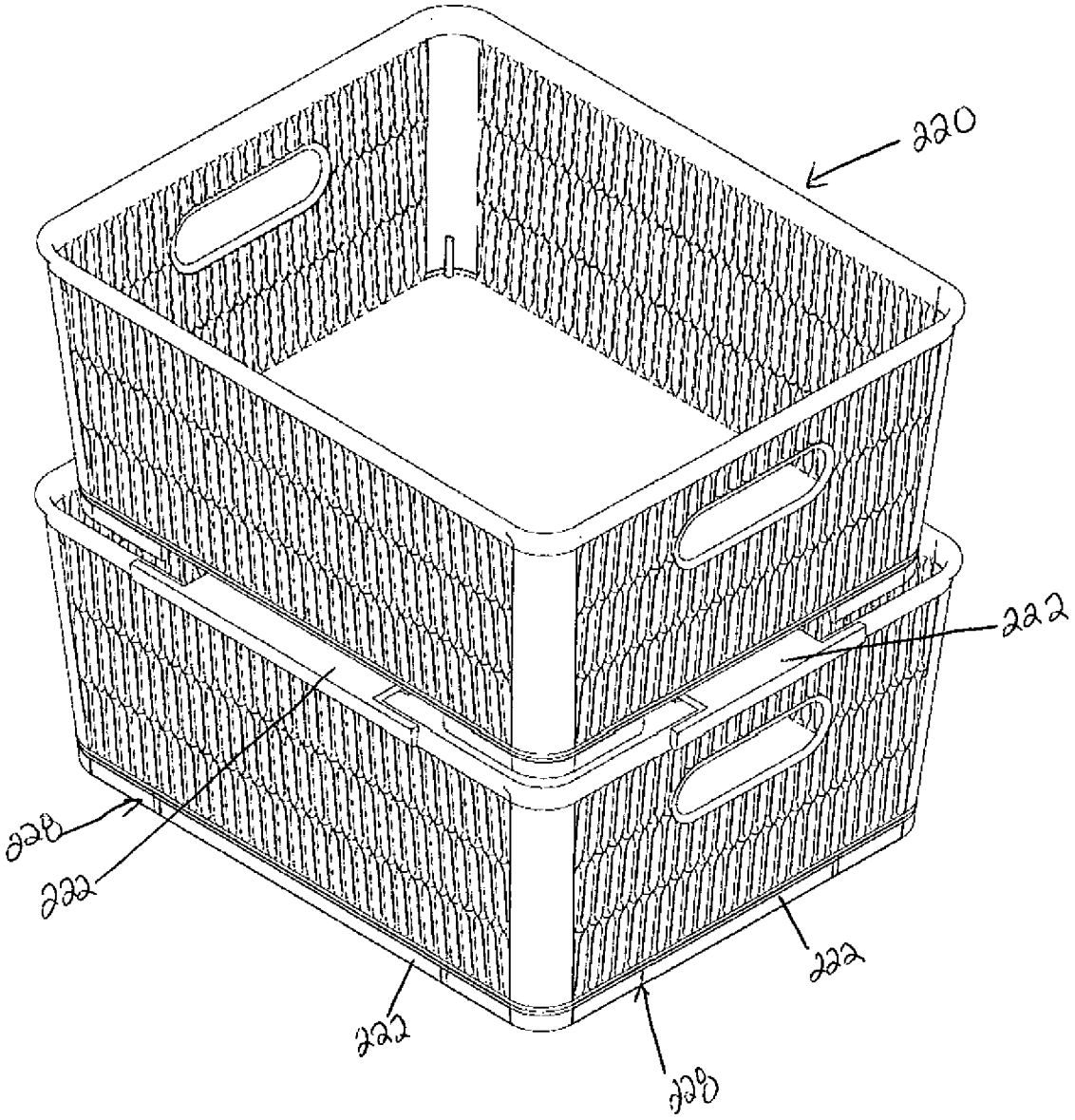
FIG. 16 is a perspective view of the third embodiment of showing two stacked containers 220 each having a rectangular shape and each having four retractable side support members 222 on each side of the bottom surface of each, wherein the retractable side support members 222 are supporting the upper container.

FIG. 16 is a perspective view of the third embodiment showing two stacked containers 220 each having a rectangular or square shape and each having four retractable support members 222 on each of the four sides of the bottom surface of each, wherein the retractable support members 222 are supporting the upper container 220, and wherein the side support members 222 are each moveable into and out of a respective side groove 228 formed in the base wall 212, so that each side groove 228 is shaped to receive a support member 222.

Figure 16A:
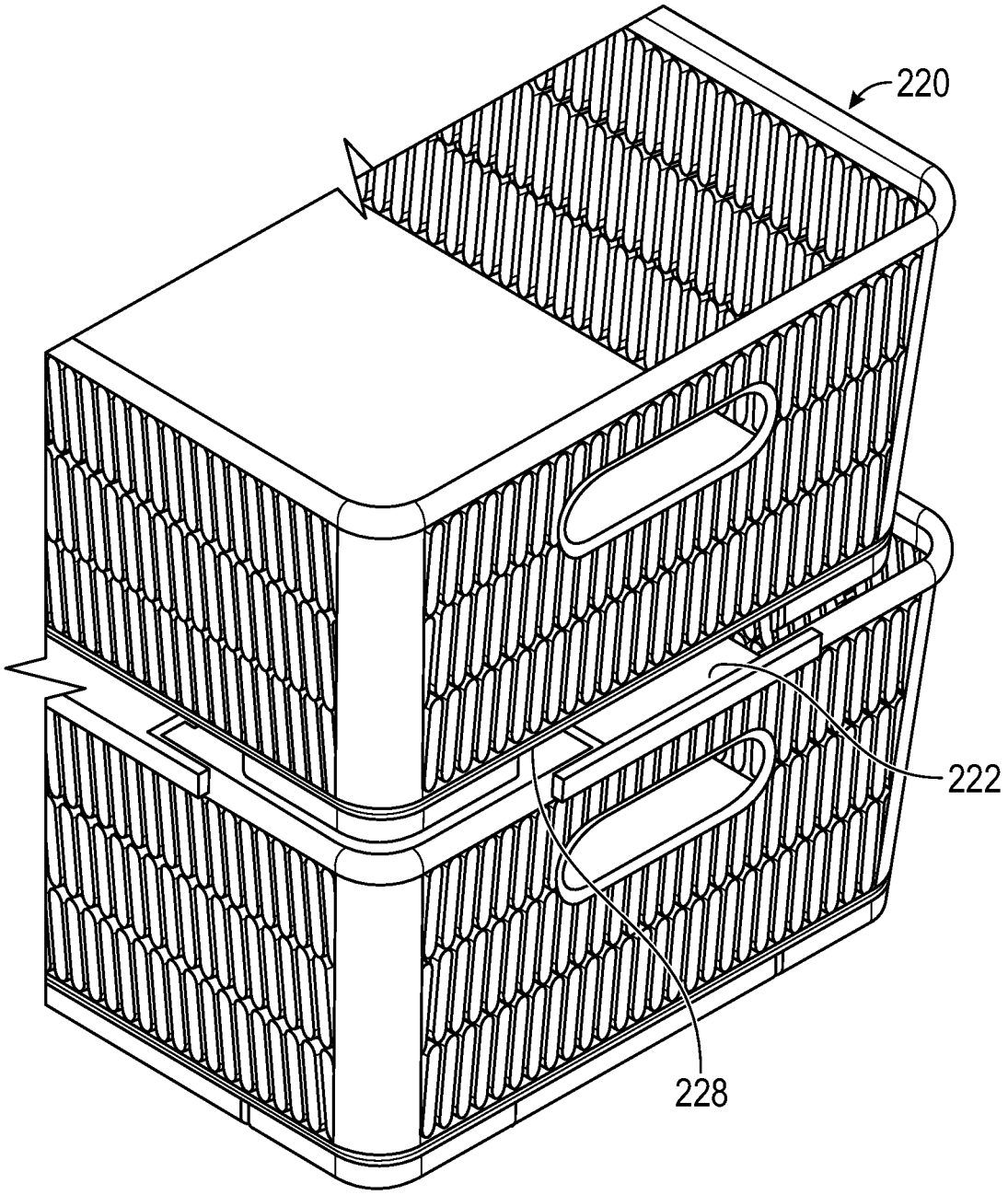
FIG. 16A is a partial, enlarged perspective end view of the third embodiment shown in FIG. 16 showing two stacked containers 220 each having a rectangular shape and each having four retractable side support members 222 on each side of the bottom surface of each, wherein the retractable side support members 222 are supporting the upper container.

FIG. 16A is a partial, enlarged perspective end view of the third embodiment shown in FIG. 16 showing two stacked containers 220 each having a rectangular shape and each having four retractable side support members 222 on each side of the bottom surface of each, wherein the retractable side support members 222 are supporting the upper container.

Figure 17:
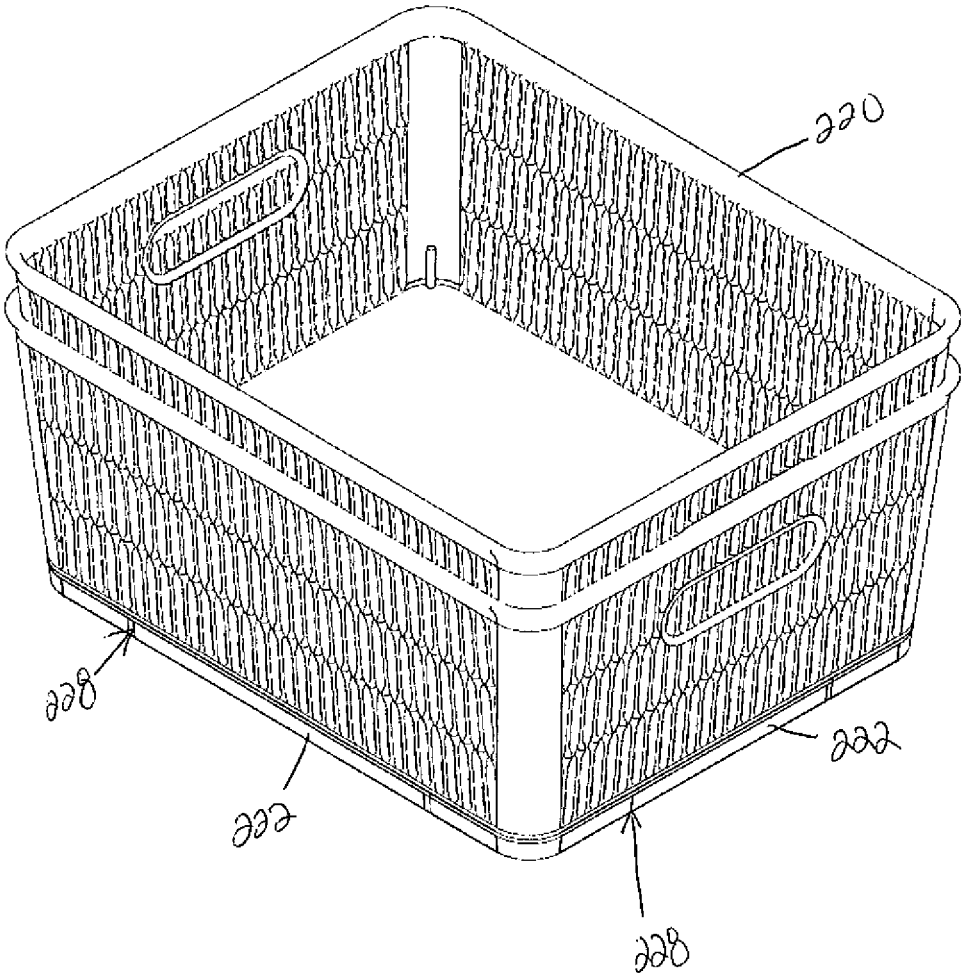
FIG. 17 is a perspective view of the third embodiment of showing two containers 220 each having a rectangular shape and each having four retractable side support members 222 on each side of the bottom surface of each, wherein the containers are nested inside each other, and wherein the side support members 222 are in their retracted positions.

FIG. 17 is a perspective view of the third embodiment showing two containers 220 each having a rectangular or square shape and each having four retractable support members 222, one on each of the four sides of the bottom surface of each, wherein the containers 220 are nested inside each other, and wherein the retractable support members 222 are in their retracted positions.

Figure 18:
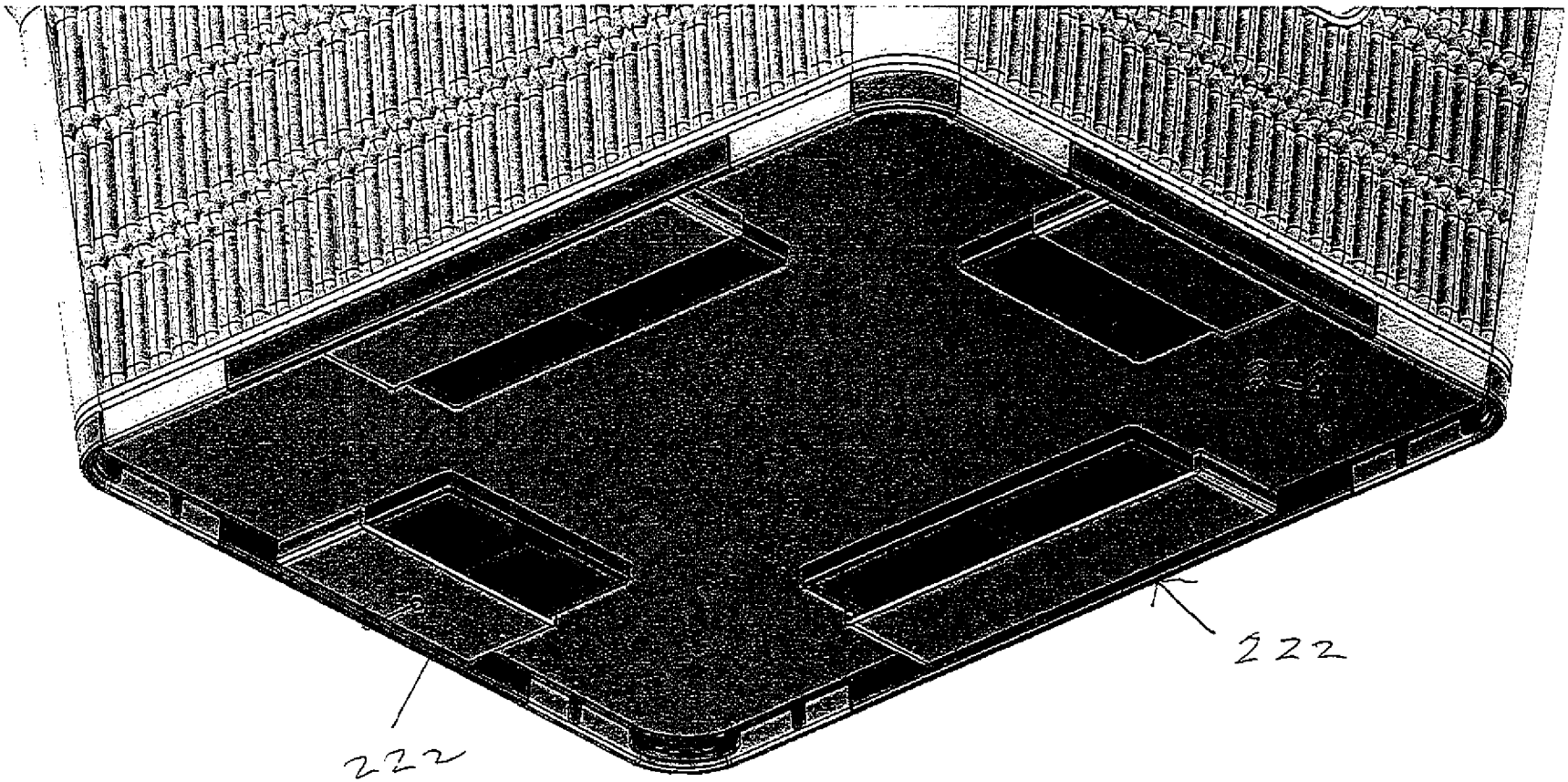
FIG. 18 is a perspective view of the third embodiment showing the bottom of the container, wherein the side support members 222 are in their retracted positions.

FIG. 18 is a perspective view of the third embodiment showing the bottom of the container 220, wherein the retractable support members 222 are shown in their retracted positions, so the containers can nest with each other.

Operation of First Embodiment

The present invention provides a stackable container 20, having a base wall and multiple corners, a side wall that is generally perpendicular to the base wall, and an end wall that is generally perpendicular to the base wall and the side wall. The base wall, the side wall, and the end wall are preferably substantially rectangular or square in shape and define an interior space. Also, a plurality of retractable support members 22 are provided that are movable between an extended support position and a retracted position. The support members 22, preferably located at the four bottom corners of the base wall of the stackable container, support the stackable container on top of another container when the support members are in an extended support position.

As shown in detail in FIGS. 6, 7, and 8, each support member 22 has a slideable arm 24, a locking hook 30, which locks slideable arm 24 into is extended position, and a stop member 26, which are all movable in a groove 28 formed in the base wall 12 that is preferably at least partially shaped to receive the support members 22. Preferably each of the support members 22 fits flush within and forms part of the base wall 12 when each of the support members 22 is in the retracted position. The curved end member 32 of each support member 22 preferably has a substantially curved shape and is substantially perpendicular to the slideable arm 24. The slideable arm 24 of each support member 22 preferably has a substantially rectangular shape.

FIG. 9 shows a perspective view of the two containers 20 stacked above each other, wherein the corner support members 22 are supporting the upper container 20. FIG. 10 is a perspective view of the two containers 20 nested inside each other, wherein the corner support members 22 are in their retracted positions, so the containers can be nested.

Operation of Second Embodiment

FIGS. 11 to 14 show the second embodiment having the stackable container 120, having a base wall 112 and curved side walls that are generally perpendicular to the base wall to form a circular container. Also, a plurality of retractable support members 122 are provided that are movable between an extended support position and a retracted position. The support members 122, preferably located at the bottom of the base wall of the stackable container 120, support the stackable container 120 on top of another container 120 when the support members 122 are in extended support positions.

As shown in FIGS. 11 to 14, each support member 122 has a slideable arm 124, a hook member 126, and a stop 130, which are movable in a groove 128 formed in the base wall 112 that is shaped to receive the support members 122. Preferably each of the support members 122 fits flush within and forms part of the base wall 112 when each of the support members 122 is in the retracted position. The curved end member 132 of each support member 122 preferably has a substantially curved shape and is substantially perpendicular to the slideable arm 124. The slideable arm 124 of each support member preferably has a substantially rectangular shape.

FIG. 11 is also a perspective view of a second embodiment of a stackable container 120 having a circular shape and having at least three retractable support members 122 around the bottom surface of container 120.

FIG. 12 is also a perspective view of the second embodiment showing two stacked containers 120 each having a circular shape and each having at least three retractable support members 122 around the bottom surface of each, wherein the corner support members 122 are supporting the upper circular container 120.

FIGS. 13 and 14 are perspective views of the second embodiment showing two containers 120 each having a circular shape and each having at least three retractable support members 122 around the bottom surface of each, wherein the containers 120 are nested inside each other, and wherein the corner support members 122 are in their retracted positions.

Operation of Third Embodiment

FIG. 15 is a perspective view of a third embodiment of a stackable container 220 having a rectangular or square shape and having four retractable support members 222, one on each of the four sides of the bottom surface of container 220.

FIG. 16 is a perspective view of the third embodiment showing two stacked containers 220 each having a rectangular or square shape and each having four retractable support members 222, one on each of the four sides of the bottom surface of each, wherein the retractable support members 222 are supporting the upper container 220.

FIG. 16A is a partial, enlarged perspective end view of the third embodiment shown in FIG. 16 showing two stacked containers 220 each having a rectangular shape and each having four retractable side support members 222 on each side of the bottom surface of each, wherein the retractable side support members 222 are supporting the upper container.

FIG. 17 is a perspective view of the third embodiment showing two containers 220 each having a rectangular or square shape and each having four retractable support members 222, one on each of the four sides of the bottom surface of each, wherein the containers 220 are nested inside each other, and wherein the retractable support members 222 are in their retracted positions.

FIG. 18 is a perspective view of the third embodiment showing the bottom of the container, wherein the retractable support members 222 are in their retracted positions, so the containers can nest with each other.

ADVANTAGES OF THE PRESENT INVENTION

It is an advantage of the present invention to provide stackable containers for use in homes, offices or workshops for work space organization.

Another advantage of the present invention is to provide stackable containers that may be easily stacked by use of a plurality of retractable support members that are supported on another container below it.

Another advantage of the present invention is to provide stackable containers which can be stacked with similar or dissimilar containers having different shapes or sizes.

Another advantage of the present invention is to provide stackable containers wherein each stackable container has a shape of predetermined size and useable volume so that the container can be used to hold different types of products in an efficient manner.

Another advantage of the present invention is to provide stackable containers of any shape, such as square, round, rectangular, or any other shape.

Another advantage of the present invention is to provide stackable containers, wherein the top container can be rotated 180° relative to a lower container and stacked thereon.

Another advantage of the present invention is to provide stackable containers or bins that nest within each other, when they are not stacked.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A stackable container, comprising:

a) a base wall having multiple corners;

b) a side wall generally perpendicular to said base wall;

c) an end wall generally perpendicular to said base wall and said side wall;

d) wherein said base wall, said side wall, and said end wall define an interior space;

e) a plurality of retractable support members each having a slideable arm, a locking hook, and a stop member, wherein each of said slideable arms is movable into and out of a groove formed in each of said corners of said base wall, such that each of said support members is movable between an extended support position and a retracted position; and f) wherein said locking hook and said stop member locks said slideable arm of said support members in an extended position; wherein said support members support said stackable container on top of another container when said support members are in an extended support position.

2. The stackable container of claim 1, wherein said base wall, said side wall, and said end wall form a substantially rectangular or square shape.

3. The stackable container of claim 1, wherein said retractable support member has an end member that is substantially perpendicular to said slideable arm.

4. The stackable container of claim 3, wherein said end member of said support member has a substantially curved shape.

5. The stackable container of claim 1, wherein said slideable arm of said support member has a substantially rectangular shape.

6. The stackable container of claim 1, wherein at least one of said slideable arms fit flush within and forms part of said base wall when said support member is in said retracted position.

7. The stackable container of claim 1, wherein said groove is shaped to receive said retractable support member.

* * * * *